US005723023A

United States Patent [19]

Tsai et al.

[11] Patent Number: 5,723,023

[45] Date of Patent: Mar. 3, 1998

[54] METHOD OF PAPERMAKING USING MODIFIED CATIONIC STARCH

[75] Inventors: John Tsai, Belle Mead; Walter Maliczyszyn, Somerville; Teresa Capitani, Clark, all of N.J.; Christopher Kulp, Palmer, Pa.

[73] Assignee: National Starch and Chemical Investment Holding Corporation, Wilmington, Del.

[21] Appl. No.: 722,785

[22] Filed: Sep. 27, 1996

[51] Int. Cl.[6] ..... D21H 21/10

[52] U.S. Cl. ..... 162/175; 162/181.3; 162/181.6; 162/181.8; 162/183

[58] Field of Search ..... 162/175, 158, 162/181.3, 181.6, 183, 181.8; 536/102, 107, 108, 111

[56] References Cited

U.S. PATENT DOCUMENTS 5,122,231 6/1992 Anderson ..... 162/175

5,368,690 11/1994 Solarek et al. ..... 162/175

5,595,631 1/1997 Tsai et al. ..... 162/175

FOREIGN PATENT DOCUMENTS 2-133695 5/1990 Japan ..... D21H 3/28

OTHER PUBLICATIONS

D. B. Solarek, "Cationic Starches", *Modified Starches: Properties and Uses,* Chapter 8, 1986, pp. 113–129.

*Primary Examiner*—Peter Chin

*Attorney, Agent, or Firm*—Eugene Zagarella, Jr.

[57] ABSTRACT

The method of making paper wherein the use of a selected ether or ester modified, cationic starch as an additive in the papermaking wet end provides significantly improves retention and drainage properties particularly in alkaline microparticle containing systems.

18 Claims, No Drawings

METHOD OF PAPERMAKING USING MODIFIED CATIONIC STARCH

BACKGROUND OF THE INVENTION

This invention relates to an improved method of papermaking in an acid or alkaline system using a selected modified cationic starch as a wet end additive to provide improved retention of filler and fines and drainage.

The term "paper," as used herein, includes sheet-like masses and molded products made from natural sources, synthetics such as polyamides, polyesters, rayon and polyacrylic resins as well as from mineral fibers such as asbestos and glass. In addition, paper made from combinations of cellulosic and synthetic materials are applicable herein. Paperboard is also included within the broad term "paper".

Papermaking, as it is conventionally known, is a process of introducing an aqueous slurry of pulp or wood cellulosic fibers (which have been beaten or refined to achieve a level of fiber hydration and to which a variety of functional additives can be added) onto a screen or similar device in such a manner that the water is removed, thereby forming a sheet of the consolidated fibers, which upon pressing and drying can be processed into dry roll or sheet form. Two well known papermaking operations involve the Fourdrinier machine, the most common, and the cylinder machine. In the Fourdrinier and multicylinder operations, and in other machine operations, as typical in papermaking, the feed or inlet to the machine is an aqueous slurry or water suspension of pulp fibers which is provided from what is called the "wet end" system. In the wet end, the pulp along with other additives are mixed in an aqueous slurry and subject to mechanical and other operations such as beating and refining to improve interfiber bonding and other physical properties of the finished sheet. Additives commonly introduced along with the pulp fibers are pigments such as titanium dioxide, mineral fillers such as clay and calcium carbonate and other materials introduced into paper to achieve such properties as improved brightness, opacity, smoothness, ink receptivity, fire retardance, water resistance, increased bulk, etc. Also useful in papermaking are colloidal inorganic minerals, such as colloidal silica, which are added to what is typically known as a microparticle system to give better sheet formation.

Starch has been used in the paper industry for many years and in fact, is the second largest volume raw material component in paper. Starches help provide some important characteristics needed in papermaking, including strength improvement, increased drainage on the wire and retention of fines and filler. Both unmodified and modified types have been used. However, due to the complexity of today's pulp furnishes and other chemicals present, cationic modified starches are preferred since they are retained to a high degree by the paper machine furnish.

Various cationic starches are known and used in the paper industry with the tertiary amino and quaternary ammonium starch ethers being the most commercially significant derivatives. These and other cationic starches as well as the method of preparing them are described in "Cationic Starches" by D. B. Solarek, *Modified Starches: Properties and Uses*, Chapter 8, pp. 113–129, 1986.

Some recent disclosures have shown cationic, crosslinked starch to be useful in improving retention and drainage in papermaking. See U.S. Pat. No. 5,122,231 issued Jun. 16, 1992 to K. Anderson, U.S. Pat. No. 5,368,690 issued Nov. 29, 1994 to D. B. Solarek et al., and Japanese Patent Disclosure No. 2-133695 published May 22, 1990 to K. Maeda. While such modified starches and methods are useful in papermaking, they involve special crosslinking techniques and often special cooking conditions.

Despite the contributions of the above noted patents and disclosures, there remains a need in the art for papermaking systems which are easy to provide and exhibit improved retention properties, particularly in alkaline microparticle systems, as well as drainage properties.

SUMMARY OF THE INVENTION

Now it has been found that the use of a selected ether or ester modified, cationic, non-degraded starch as an additive in the wet end of a papermaking process provides significant and improved performance especially retention and drainage properties.

More particularly, this invention relates to a method of making paper comprising adding an effective additive amount of a cationic, non-degraded starch which is further modified to a degree of substitution (DS) of from about 0.005 to 0.4 with either:

a) an ether group R—O—, where R is an hydroxyalkyl or alkyl of 1 to 4 carbon atoms or alkenyl of 2 to 4 carbon atoms; or b) an ester group, $$R-\overset{\overset{\displaystyle O}{\|}}{C}-O-,$$

where R is an alkyl of 1 to 4 carbon atoms or alkenyl of 2 to 4 carbon atoms.

and wherein the non-degraded, fully modified starch has a Brookfield viscosity of at least 1000 cPs at 30° C. in an 8% aqueous solution.

DETAILED DESCRIPTION OF THE INVENTION

This invention involves the use of selected modified cationic starches as wet end additives in papermaking systems.

The starches which are used herein are cationic, non-degraded starches which are further modified with either an ether group or an ester group. This modification with either group will be to an amount sufficient to provide a DS (degree of substitution) of from about 0.005 to 0.4 and preferably from about 0.02 to 0.25. The term "degree of substitution" (DS) as used herein indicates the average number of sites per anhydroglucose unit of the starch molecule on which there are substituent groups.

The modification of starch with an ether group involves formation of an etherified starch compound having the formula:

$$ST-O-R$$

where ST represents the starch base material and R is an hydroxyalkyl or alkyl of 1 to 4 carbons, or an alkenyl of 2 to 4 carbons. Preferably the R group is an hydroxyalkyl of 2 to 3 carbon atoms. These starch ethers may be prepared by reaction with alkylene oxides and its precursor halohydrins, alkyl halides, and alkenyl halides. Etherification with alkylene oxides are preferred. Ethylene oxide, propylene oxide and butylene oxide are compounds useful in etherifying the starch materials. Other compounds such as modified alkylene oxides, e.g., allyl glycidyl ether, may be used to prepare useful starch ethers. Aryl compounds such as benzyl halide may also be used in the modification but are less preferable. Varying amounts of such compounds may be used depending on the final DS desired, as noted previously.

The ester modification involves formation of an esterified starch compound having the formula:

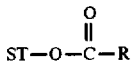

where ST represents the starch base material and R is an alkyl of 1 to 4 carbon atoms or alkenyl group of 2 to 4 carbon atoms and preferably alkyl of 1 to 2 carbon atoms. Starch esters of this type include starch acetate, starch propionate and starch butyrate. The starch esters are typically prepared by reacting starch with organic acid anhydrides such as acetic anhydride.

The modifications of starch to prepare the ethers and esters are well known in the art and a good review of such preparations may be found in R. L. Whistler, J. N. BeMiller and E. F. Paschall "Starch: Chemistry and Technology", Academic Press; 1984, Chapter X.

The starches used in this invention besides being modified with ether or ester groups are also cationically modified. Cationization of the starch can be produced by well known chemical reactions with reagents containing amino, imino, ammonium, sulfonium or phosphonium groups as disclosed, for example, in "Cationic Starches", by D. B. Solarek, in *Modified Starches: Properties and Uses*, Chapter 8, 1986, and in U.S. Pat. No. 4,119,487 issued Oct. 10, 1978 to M. Tessler. Such cationic derivatives include those containing nitrogen containing groups comprising primary, secondary, tertiary and quaternary amines and sulfonium and phosphonium groups attached through either ether or ester linkages. The preferred derivatives are those containing the tertiary amino and quaternary ammonium ether groups.

The general method for preparing starches containing tertiary amine groups, which method involves reacting starch under alkaline conditions with a dialkylaminoalkyl halide is described in U.S. Pat. No. 2,813,093 issued on Nov. 12, 1957 to C. Caldwell et al. Another method therefore is disclosed in U.S. Pat. No. 4,675,394 issued Jan. 23, 1987 to D. Solarek et al. The primary and secondary amine starches may be prepared by reacting the starch with aminoalkyl anhydrides, amino epoxides or halides, or the corresponding compounds containing aryl in addition to the alkyl groups.

Quaternary ammonium groups may be introduced into the starch by suitable treatment of the tertiary aminoalkyl ether of starch, as described in the previously noted U.S. Pat. No. 2,813,093. Alternatively, quaternary groups may be introduced directly into the starch by treatment with the reaction product of an epihalohydrin and a tertiary amine or tertiary amine salt, to provide, for example, 2-hydroxypropyl ether substituent groups as disclosed in the noted U.S. Pat. No. 4,119,487. The above noted patents, i.e., '487, '093 and '394 are incorporated herein by reference.

The preparation of cationic sulfonium derivatives is described in U.S. Pat. No. 2,989,520 issued June, 1961 to M. Rutenberg et al. and essentially involves the reaction of starch in an aqueous alkaline medium with a beta-halogenoalkylsulfonium salt, vinylsulfonium salt or epoxyalkyl-sulfonium salt. The preparation of cationic phosphonium derivatives is disclosed in U.S. Pat. No. 3,077,469 issued Feb. 12, 1963 to A. Aszalos and involves reaction of starch in an aqueous alkaline medium with a beta-halogenoalkylphosphonium salt.

Other suitable cationic starches may be provided using reagents and methods that are well known in the art as illustrated in the above noted references. Further description of useful cationic starches are disclosed in U.S. Pat. No. 2,876,217 issued Mar. 3, 1959 to E. Paschall, U.S. Pat. No. 2,970,140 issued Jan. 31, 1961 to C. Hullinger et al., U.S. Pat. No. 5,004,808 issued Apr. 2, 1991 to M. Yalpani et al., U.S. Pat. No. 5,093,159 issued Mar. 3, 1992 to J. Fernandez et al. and U.S. Pat. No. 5,227,481 issued Jul. 13, 1993 to J. Tsai et al., all of which are incorporated herein by reference. Particularly useful cationic derivatives are those containing amino or nitrogen groups having alkyl, aryl, alkaryl, aralkyl or cyclic substitutents of up to 18 carbon atoms and especially alkyl of 1 to 6 carbon atoms.

The amount of cationic substituent on the starch can be varied and generally a degree of substitution (DS) of from about 0.005 to 0.2 and preferably from about 0.01 to 0.05 will be used. While larger amounts of cationic substituents or higher degrees of substitution (DS) could be used, they are more costly and difficult to make and therefore not economically attractive.

The sequence of starch modification can be cationic first and then ether or ester, or it can be in the reverse order. However, in the case of ester modification, it is preferred to add the cationic group first. The process of modification can be performed in separate steps or in a continuous manner without separation of the intermediate starch derivatives. In any of these modifications, the starch can be in the granular state or in a dispersion utilizing aqueous or organic solvent solution.

The base starch material used in preparing the cationic and modified starches may be any of the native starches and more particularly the amylose containing starches, i.e., starches having at least 5% amylose content. Such starches include those derived from plant sources such as corn, potato, wheat, rice, tapioca, waxy maize, sago, sorghum and high amylose starch such as high amylose corn, i.e., starch having at least 45% amylose content. Starch flours may also be used. Especially useful starches are the amylose containing starches and particularly corn, potato and tapioca starch.

While any native starch may be used in this invention, it is important that the starch is largely or essentially non-degraded to provide better retention of filler and fines in the paper system. More particularly the starch used in this invention is non-degraded and has a viscosity of at least 1,000 cPs at 30° C. in an 8% aqueous solution. Typically starches used in this invention will have a viscosity of from 1,000 to 100,000 cPs and preferably from 5,000 to 20,000 cPs at 30° C. in an 8% aqueous solution. This viscosity is that of the starch after complete or full modification, i.e., the final starch product, which is modified with the cationic group as well as the ether or ester group. The viscosity as used herein is a Brookfield viscosity measured using a Brookfield viscometer model no. DV-II with spindle no. 5 and 6 at 20 rpm.

The modified starch is cooked or gelatinized prior to addition to the papermaking system to solubilize and disperse it. This is easily accomplished using standard conditions and known techniques including atmospheric cooking, and jet cooking or steam injection cooking. Typical cooking temperatures can range from a temperature of at least the gelatinization temperature of the starch and can be from about 55° to 200° C. or higher depending on the starch, the conditions and type of cooking being utilized. It is noted that because the modified starches of this invention are not crosslinked, extremely high temperatures and high pressure are not required for dispersion.

The amount of ether or ester modified, cationic starch that may be added to the wet end or paper pulp will be an effective additive amount. More particularly, from about 0.05 to 10% of the starch derivative, and preferably from about 0.1 to 5% by weight based on the dry weight of the pulp will be used.

The modified starch additive of the present invention may be successfully utilized for the addition to paper and paperboard prepared from all types of both cellulosic and synthetic fibers and combinations of cellulosic with non-cellulosic fiber. Also included are sheet-like masses and molded products prepared from combinations of cellulosic and non-cellulosic materials derived from synthetics such as polyamide, polyester and polyacrylic resin fibers as well as from mineral fibers such as asbestos and glass. The hardwood or softwood cellulosic fibers which may be used include bleached and unbleached sulfate (Kraft), bleached and unbleached sulfite, bleached and unbleached soda, neutral sulfite, semi-chemical, groundwood, chemi-groundwood, and any combination of these fibers. In addition, synthetic cellulosic fibers of the viscose rayon or regenerated cellulose type can also be used, as well as recycled waste papers from various sources.

All types of pigments and fillers may be added in the usual manner to the pulp which is to be modified with the starch derivatives of this invention. Such materials include clay, titanium dioxide, talc, calcium carbonate, calcium sulfate and diatomaceous earths. Rosin may also be present, if desired.

Other additives commonly introduced into paper may be added to the pulp or furnish, for example, dyes, pigments, sizing additives, alum, and cationic, anionic and amphoteric retention aids, etc.

The selected starch derivatives of this invention have been found especially useful in papermaking involving microparticle systems because they significantly enhance retention of precipitated calcium carbonate (PCC). Microparticle papermaking systems can be acid, neutral or alkaline in nature with alkaline systems being most prevelant. Alkaline microparticle systems are formed in the papermaking operation by adding colloidal inorganic minerals. Such microparticle systems include colloidal silica, bentonite and anionic alum and may be incorporated into the system in amounts of at least 0.001% and more particularly from about 0.01 to 1% by weight based on the weight of dry pulp. Further description of such microparticle inorganic materials may be found in U.S. Pat. Nos. 4,388,150 issued Jun. 14, 1983; 4,643,801 issued Feb. 17, 1987; 4,753,710 issued Jun. 28, 1988 and 4,913,775 issued Apr. 3, 1990; all of which are incorporated herein by reference.

Additionally, the described starches do not require a degree of cross-linking in order to perform effectively. This is especially useful, as measuring the cross-linking characteristic of starches, and thus predicting their performance, can be difficult. Furthermore, the described starches can be easily dispersed under standard cooking parameters, while most crosslinked starches require somewhat harsher conditions.

The following examples will further illustrate the embodiments of this invention. In these examples all parts are given by weight and all temperatures in degrees Celsius unless otherwise noted.

EXAMPLE 1

This example illustrates the preparation of ether modified, cationic starch derivatives of this invention and their use in papermaking systems.

A cationic corn starch was prepared in the following manner. Corn starch, 100 parts, was slurried in 150 parts water and 0.8 parts sodium hydroxide added as a 3% solution. The slurry was heated to 40° to 45° C. and 5 parts of (3-chloro-2-hydroxypropyl)trimethyl ammonium chloride added as a 65% aqueous solution with simultaneous addition of approximately 3.5 parts sodium hydroxide as a 3% solution to maintain a pH of 11.5. After 12 to 16 hours reaction at 40° to 45° C., the slurry was neutralized to pH of 6.0 with dilute hydrochloric acid (3:1). The starch was recovered by filtration, washed twice with water and dried. The product had a nitrogen content of 0.30% by weight on a dry basis (db).

The cationic corn starch, prepared as described above was then modified with 4% propylene oxide in the following manner. In a sealed container, one hundred (100) parts of the cationic corn starch described above was slurried in 150 parts water in which 30 parts sodium sulfate was dissolved and 1.5 parts of sodium hydroxide added as a 3% solution. The slurry was then heated to 40° to 45° C., 4 parts of propylene oxide added and the slurry agitated at 40° to 45° C. for 12 to 16 hours. The slurry was cooled to 25° C. and neutralized to 3.0 to 3.5 pH with dilute hydrochloric acid. After 1 hour, the starch slurry was adjusted to 5.5 pH with sodium hydroxide (3% solution). The starch product was recovered by filtration, washed three times with water and air dried. Hydroxypropyl substitution was determined by proton NMR spectral analysis to be 0.098 DS.

The starch sample was cooked in a mini-jet cooker (scaled down jet cooker to simulate a commercial jet cooker) at a temperature of 130° C. (230° F.). The starch derivative was evaluated in a papermaking system for retention performance using a modified Dynamic Retention Evaluation test with a Britt jar as described below.

A standard papermaking furnish was prepared using a pulp stock which comprised an aqueous slurry of bleached hardwood kraft pulp (BHWK) and bleached softwood kraft pulp (BSWK). The pulp stock (80:20, HW:SW, percent by weight) was refined in an aqueous solution to about 400 CSF (Canadian Standard Freeness) beat at 1.5% consistency using conditioned water. The resulting head box was made to 0.5% consistency with 30% of headbox solids being precipitated calcium carbonate (Albacar HO).

A sample of 500 ml. pulp stock was placed in a 4" Britt jar (equipped with 70 mesh screen and agitator) and mixed at 400 rpm. Alum, 5 lb./ton (1% soln) was added and mixed at 400 rpm for 20 seconds and then mixing was increased to 1000 rpm. After 10 seconds, the starch, 15 lb./ton (0.5% soln) was added and mixing continued for another 30 seconds. Colloidal silica, 3 lb/ton (0.1% soln) was added and mixed for 15 seconds. The system was then drained and samples were collected, filtered, dried and microwave ashed. Using computer spreadsheets, average calcium carbonate filler retention as well as average fines retention were determined and shown in Table 1.

Additional modified cationic starch samples with 2 and 6% propylene oxide were also prepared and formed into papermaking furnish and evaluated for retention properties as above. All results are given in Table 1.

TABLE 1

| Sample | Starch Identification Modified Cationic Corn[1] | DS[3] | Ave $CaCO_3$ Retention (%) | Ave. Fines Retention (%) |
|---|---|---|---|---|
| A | 2% Propylene Oxide[1] | 0.047 | 38.4 | 65.4 |
| B | 4% Propylene Oxide[1] | 0.098 | 38.1 | 62.4 |
| C | 6% Propylene Oxide[1] | 0.147 | 36.7 | 70.5 |
| Commercial | Cationic Potato Starch[2] | 0 | 35.0 | 69.1 |
| Control | Cationic Corn[1] | 0 | 30.5 | 63.5 |

[1]Corn starch modified with 3-chloro-2-hydroxypropyltrimethyl ammonium chloride to nitrogen content of 0.30%
[2]Quaternary potato starch with 0.4% nitrogen content
[3]DS of hydroxypropyl substituent

EXAMPLE 2

This example illustrates the preparation of ester modified, cationic starch derivatives of this invention and their use in papermaking systems.

The cationic corn starch, prepared as described above in Example 1, was further modified with 4% acetic anhydride in the following manner. One hundred (100) parts of cationic corn starch was slurried in 125 parts water and the pH adjusted to 8.0 by the addition of dilute sodium hydroxide (3%). Four (4) parts of acetic anhydride was added slowly to the agitated starch slurry with the pH maintained at 8.0 to 8.25 by the metered addition of dilute sodium hydroxide. After the reaction was complete, the pH was adjusted to 5.5 with dilute hydrochloric acid (3:1). The starch product was recovered by filtration, washed three times with water and air dried. The starch product had an acetyl content of 0.061 DS as determined by proton NMR spectral analysis.

Additional modified cationic starch derivatives with 2 and 6% acetic anhydride were also prepared. The prepared starch derivatives were then cooked and a papermaking furnish containing the starch derivative was formed in the same manner as Example 1. Retention performance was evaluated using a modified Dynamic Retention Evaluation test as described in Example 1. Results are shown below in Table 2.

TABLE 2

| Sample | Starch Identification Modified Cationic Corn[1] | DS[3] | Ave $CaCO_3$ Retention (%) | Ave. Fines Retention (%) |
|---|---|---|---|---|
| D | 2% Acetic Anhydride[1] | 0.031 | 39.1 | 64.9 |
| E | 4% Acetic Anhydride[1] | 0.061 | 36.8 | 63.6 |
| F | 6% Acetic Anhydride[1] | 0.092 | 40.4 | 65.8 |
| Commercial | Cationic Potato Starch[2] | 0 | 35.0 | 69.1 |
| Control | Cationic Corn[1] | 0 | 30.5 | 63.5 |

[1]Corn starch modified with 3-chloro-2-hydroxypropyltrimethyl ammonium chloride to nitrogen content of 0.30%
[2]Quaternary potato starch with 0.4% nitrogen content
[3]DS of acetyl substituent

EXAMPLE 3

Using the same standard papermaking furnish as in Example 1, 80 HW: 20 SW bleached, 400 CSF beat at 1.5% consistency; standard headbox at 0.5% consistency and 30% solids PCC (precipitated calcium carbonate), drainage properties were determined for the starch samples prepared as described in Examples 1 and 2. The drainage properties were determined through computer-enhanced Turbulent Pulse Sheet Former (TPSF) testing in which a 4" Britt jar procedure was utilized as described below.

The sheets prepared in the Britt jar for TPSF testing possessed a basis weight of about 60 lb/3300 $ft^2$. The TPSF testing conditions comprised a 4" Britt jar equipped with 70 mesh screen, air pressure ~20 in $H_2O$, vacuum pressure ~7.5 in Hg, stirrer speed of 1000 rpm, stirrer height of 1.5" from baffle bottom, air pulse time of 0.5 sec., vacuum pulse time of 0.3 sec. and a total of three pulses for sheet formation. A sample of pulp stock was placed in the jar and agitated at about 1000 rpm. Alum, 5 lb./ton (1% soln) was added and mixed at 1000 rpm for 30 seconds. The starch, 10 lb./ton (0.5% soln) was then added and mixing continued for another 30 seconds. Colloidal silica, 3 lb./ton (0.1% soln) was added and sheet formation initiated. Using a computer program, the pulsing and sheet formation characteristics were translated into drainage measurement profiles and the overall drainage resistance (ODR) of each formed sheet. A number of repeat samples (5) were performed for each test sample and the average ODR determined. The smaller the ODR the better the drainage performance of the additive.

The results for the drainage evaluation of all samples are given below in Table 3.

TABLE 3

| Sample | Starch Identification Modified Cationic Corn[1] | DS[3] | Ave ODR (psig-sec) |
|---|---|---|---|
| G | 2% Propylene Oxide[1] | 0.047 | 514 |
| H | 4% Propylene Oxide[1] | 0.098 | 613 |
| I | 6% Propylene Oxide[1] | 0.147 | 693 |
| J | 2% Acetic Anhydride[1] | 0.031 | 510 |
| K | 4% Acetic Anhydride[1] | 0.061 | 658 |
| L | 6% Acetic Anhydride[1] | 0.092 | 546 |

TABLE 3-continued

| Sample | Starch Identification Modified Cationic Corn[1] | DS[3] | Ave ODR (psig-sec) |
|---|---|---|---|
| Blank | | 0 | 788 |
| Control | Cationic Corn[1] | 0 | 493 |
| Commercial | Cationic Potato Starch[2] | 0 | 708 |

[1]Corn starch modified with 3-chloro-2-hydroxypropyltrimethyl ammonium chloride to nitrogen content of 0.30%
[2]Quaternary potato starch with 0.4% nitrogen content
[3]DS of hydroxypropyl or acetyl substituent

EXAMPLE 4

This example shows the results when adding a cationic waxy starch, a known aid for drainage performance, to the papermaking system which contains the starch derivatives of this invention. Drainage may be improved without adversely affecting fines and filler retention. In this example, a 50/50 blend of the modified starch of this invention (Sample F) and the additive cationic waxy maize was added to the standard papermaking furnish prepared as in Example 1 and the drainage and retention performance determined as in the previous examples. Results are shown below in Table 4.

TABLE 4

| Sample | Starch identification Modified Cationic Corn[1] | Additive Starch | Ave ODR (psig-sec) | Ave $CaCO_3$ Retention (%) | Ave Fines Retention (%) |
|---|---|---|---|---|---|
| M | 6% Acetic Anhydride[1] | Cationic Waxy Maize[2] | 633 | 37.0 | 67.9 |
| N | 6% Acetic Anhydride[1] | Cationic Waxy Maize[3] | 440 | 37.3 | 64.2 |
| F | 6% Acetic Anhydride[1] | — | 546 | 40.4 | 65.8 |

[1]Corn starch modified with 3-chloro-2-hydroxypropyltrimethyl ammonium chloride to nitrogen content of 0.30%
[2]Cationic waxy maize, nitrogen content 0.30%
[3]Cationic waxy maize, nitrogen content 0.37%

What is claimed is:

1. A method of making paper having improved retention and drainage properties comprising adding to the wet end system an effective additive amount of a cationic, non-degraded starch having a degree of substitution (DS) of at least 0.005, which is further modified to a degree of substitution (DS) of from about 0.005 to 0.4 with either:

a) an ether group, R—O—, where R is an hydroxyalkyl or alkyl of 1 to 4 carbon atoms or alkenyl of 2 to 4 carbon atoms; or b) an ester group, $$R-\overset{\overset{\displaystyle O}{\|}}{C}-O-,$$

where R is an alkyl of 1 to 4 carbon atoms or alkenyl of 2 to 4 carbon atoms, and wherein the non-degraded fully modified starch has a Brookfield viscosity of at least 1000 cPs at 30° C. in an aqueous solution and is cooked prior to addition to the wet end system.

2. The method of claim 1 wherein 0.05 to 10% by weight of the modified, cationic starch is used based on the weight of dry pulp.

3. The method of claim 2 wherein the starch is an amylose containing starch having at least 5% amylose content.

4. The method of claim 2 wherein the R in the ether group is an hydroxyalkyl of 2 to 3 carbon atoms and the R in the ester group is an alkyl of 1 to 2 carbon atoms.

5. The method of claim 4 wherein the fully modified starch has a Brookfield viscosity of from 1,000 to 100,000 cPs at 30° C. in an 8% aqueous solution.

6. The method of claim 5 wherein the starch is cationized with a tertiary amino or quaternary ammonium ether group.

7. The method of claim 5 wherein the starch is an amylose containing starch having at least 5% amylose content.

8. The method of claim 7 wherein the starch is further modified to a DS of from about 0.02 to 0.25.

9. The method of claim 5 wherein the starch is corn, potato or tapioca starch.

10. The method of claim 9 wherein the starch is cationized with a tertiary amino or quaternary ammonium ether group.

11. The method of claim 10 wherein the starch is further modified to a DS of from about 0.02 to 0.25.

12. The method of claim 1 wherein the wet end system further comprises an alkaline microparticle system containing colloidal inorganic minerals selected from the group consisting of colloidal silica, bentonite and anionic alum.

13. The method of claim 8 wherein the wet system further comprises an alkaline microparticle system containing colloidal inorganic minerals selected from the group consisting of colloidal silica, bentonite and anionic alum.

14. The method of claim 13 wherein the starch is cationized with a tertiary amino or quaternary ammonium ether group.

15. Paper made by the method of claim 1.

16. Paper made by the method of claim 5.

17. Paper made by the method of claim 12.

18. Paper made by the method of claim 14.

* * * * *